United States Patent [19]

Dinges

[11] 4,406,106

[45] Sep. 27, 1983

[54] CONCEALED FASTENER PANEL CONSTRUCTION AND METHOD OF INSTALLATION

[76] Inventor: Kenneth N. Dinges, 5609 S. 84th E. Ave., Tulsa, Okla. 74145

[21] Appl. No.: 253,534

[22] Filed: Apr. 13, 1981

Related U.S. Application Data

[63] Continuation-in-part of Ser. No. 27,289, Apr. 5, 1979, Pat. No. 4,285,182.

[51] Int. Cl.[2] ..... E04B 1/40; E04D 3/361

[52] U.S. Cl. ..... 52/478; 52/520; 52/543; 52/748

[58] Field of Search ..... 52/519, 520, 522, 543, 52/545, 478, 394, 530, 713, 726, 748

[56] References Cited

U.S. PATENT DOCUMENTS

| | | | |
|---|---|---|---|
| 2,570,326 | 10/1951 | De Angelis | 52/553 |
| 3,716,958 | 2/1973 | Scrivener | 52/713 |
| 3,724,154 | 4/1973 | Cookson | 52/553 |
| 3,852,929 | 10/1974 | Cookson | 52/543 |
| 4,223,503 | 9/1980 | Hague | 52/530 |
| 4,271,653 | 6/1981 | Buchhorn | 52/553 |
| 4,285,182 | 8/1981 | Dinges | 52/478 |

FOREIGN PATENT DOCUMENTS

| | | | |
|---|---|---|---|
| 517379 | 2/1953 | Belgium | 52/520 |

*Primary Examiner*—James L. Ridgill, Jr.
*Attorney, Agent, or Firm*—Harness, Dickey & Pierce

[57] ABSTRACT

A panel construction for roofs and walls of buildings incorporates holding clips secured to supporting roof purlins with the aid of a template and positioning device which establishes the spacing of the clips. The panels, of sheet material, have hollow upstanding dovetailed latching or holding ribs extending longitudinally of medial areas thereof. Complemental partial latching rib portions are provided along the longitudinal edges of the panels which interlock in sealed engagement with the complemental partial rib portions of adjacent panels, to define complete dovetailed latching ribs at the joints of the adjoining panels. The latching ribs are shaped to conform to the retaining portions of the clips and during assembly are snapped into latched relation with the clips by pressure exerted, as by means of the foot of the installer, on the tops of the ribbed portions of the panels. Beneath the lapped portions of adjacent panels the purlins are bridged by lap supporting beam members which are keyed to the clips.

9 Claims, 22 Drawing Figures

CONCEALED FASTENER PANEL CONSTRUCTION AND METHOD OF INSTALLATION

REFERENCE TO PRIOR APPLICATION

The present application is a continuation-in-part of prior application Ser. No. 27,289 filed Apr. 5, 1979, now U.S. Pat. No. 4,285,182 issued Aug. 25, 1981.

BACKGROUND OF THE INVENTION

The construction and installation of prefabricated panels in the roof and sidewall areas of building construction has been the object of much design effort, and a number of different designs have been commercially successful to varying degrees. The present invention relates to structures of the type wherein panels are preformed of sheet metal or other strong sheet material and are provided with longitudinal ribbing which forms a part of the retaining means for securing the panels to blind fastening clips attached to the building frame structure.

Building panels so designed as to be held from beneath by fastening means which require no apertures in the panels and which provide a leakproof structure under the severe conditions encountered in roofing applications have been designed with standing seams which are deformed during installation of the panels to interlock the edges of adjacent panels and simultaneously interlock the seamed areas with underlying fastener clips preattached to the framing elements of the building. Although a number of such systems achieve satisfactory performance, many of them require that each workman be equipped with a heavy and expensive seam crimping machine which he must often manipulate on a roof under difficult conditions. The seaming machines are also typically slow, and involve dealing with an electrical supply cord. The design of the preformed seamable contours in the panels also frequently prevents efficient nesting of the panels for shipment. It will be appreciated that these disadvantageous factors have the net effect of adding to the cost of the finished structure.

Where seaming machines are used they also usually leave marks on the seams, which is of course undesirable when the panels are to be installed in areas which are readily visible, as in wall construction.

Preformed seam portions have also been used which are designed to be pounded together and onto underlying holding clips in the field by means of a rubber mallet. Due to the small size of such pounded seams, however it is difficult to insure that they are fully interlocked, leakproof and capable of withstanding the high lift off forces created by winds. Also, during installation almost all known panel designs present locating or positioning problems in that a significant amount of time may be required to make sure that the anchoring means are properly spaced and/or that all through fasteners in fact pass through the supporting structure. Many prior standing seam designs also require a separate cap element. The present invention eliminates such problems and requires no cap.

With the foregoing in mind, it is the overall object of the present invention to provide an improved panel construction of the general type disclosed in the aforementioned prior application, which is so designed that the installer can secure the panels to the principal attaching means and thereby to the frame structure of the building merely by pressing the panels into place with his foot, but which is inherently stronger and more quickly installable than the construction disclosed in said prior application.

BRIEF DESCRIPTION OF THE FIGURES OF DRAWING

Figure 19:
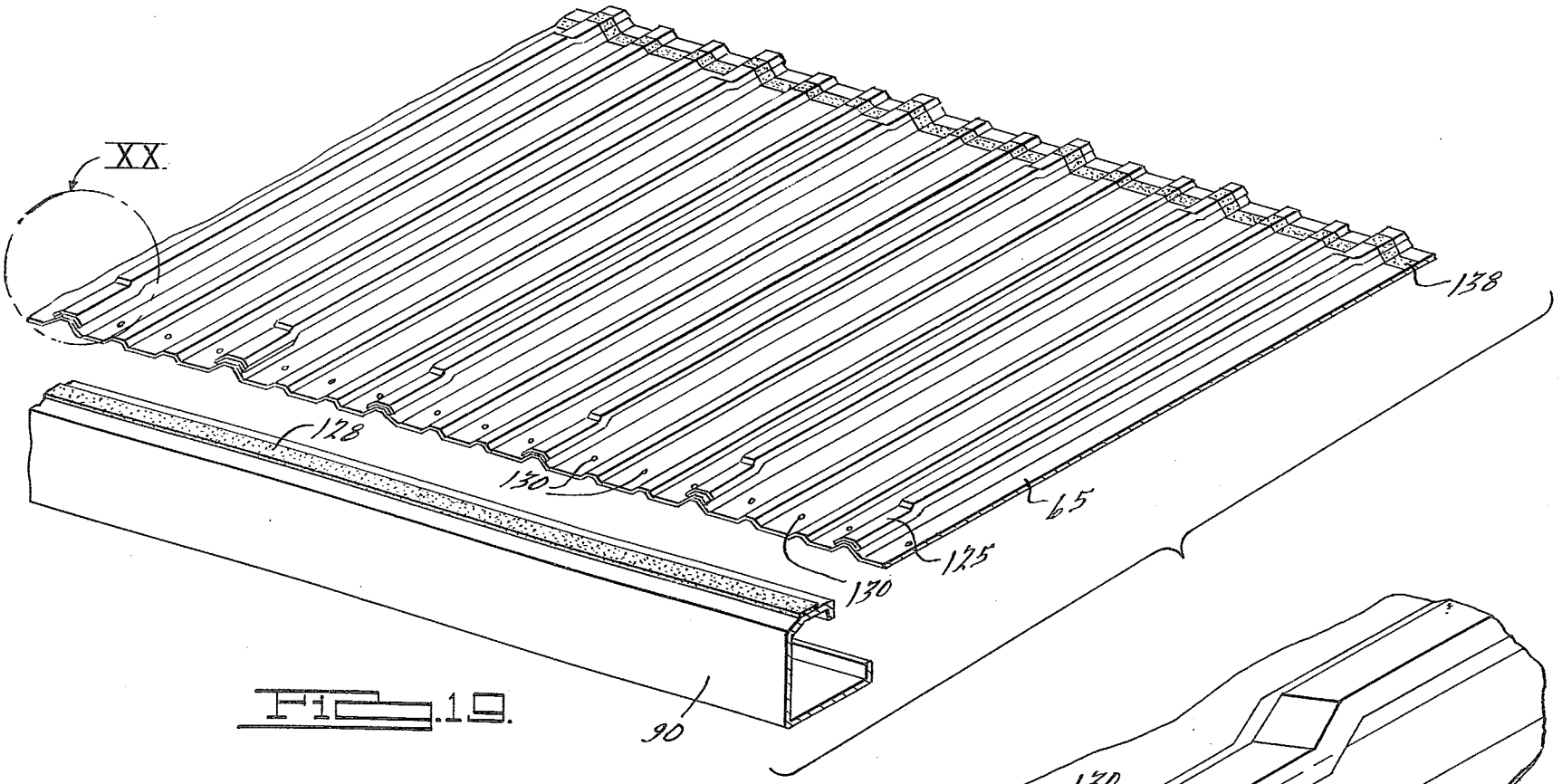
Figure 20:
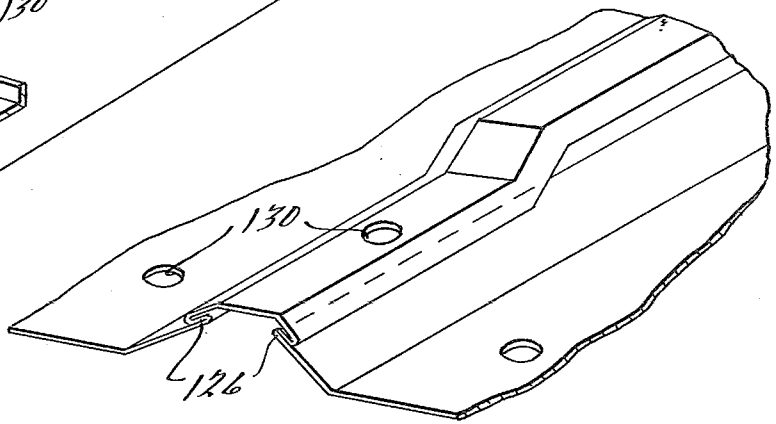
Figure 21:
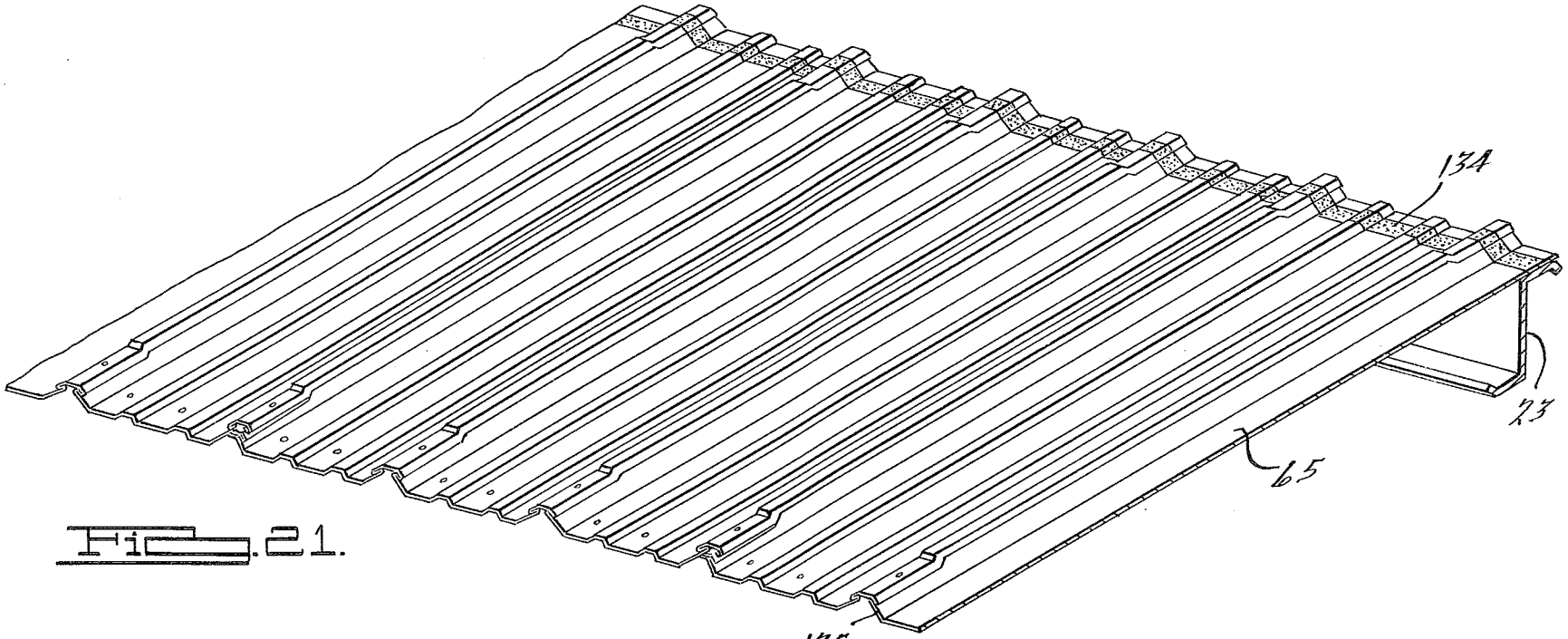
Figure 22:
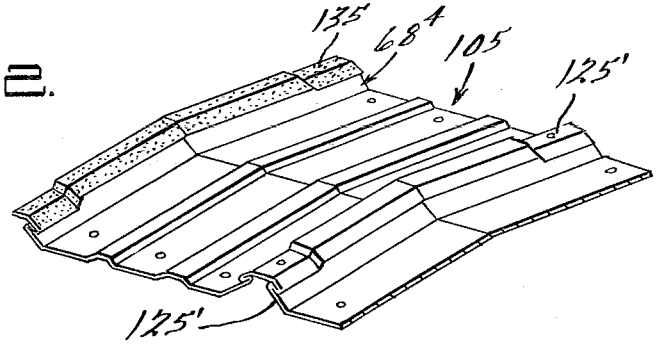

FIGS. 12 through 18 inclusive are diagrammatic sectional elevational views illustrating steps involved in the installation of the roofing panels;

FIG. 19 is a somewhat diagrammatic exploded perspective view of a series of assembled sloping roof panels, and a portion of an eave strut shown spacedly beneath the lower ends of the panel members, illustrating the configuration and the method of securance of the lower end portions of the panels of a roofing structure constructed in accordance with the invention;

FIG. 20 is an enlarged fragmentary view of the portion shown in the circle designated XX in FIG. 19;

FIG. 21 is a view similar to FIG. 19 showing an upper series of assembled panel members laid in position over a ridge purlin at the upper ends thereof and at the lower ends adapted to be laid over and secured, together with the upper ends of the panel members of FIG. 19, to an intermediate roof purlin (not shown), and FIG. 22 is a fragmentary perspective view of a ridge panel construction.

DETAILED DESCRIPTION OF PREFERRED FORM OF THE INVENTION

Although the panel construction of the present invention is utilizable in the erection of walls, as well as for roofing, the typical construction to be described herein relates to roof structure.

Reference character 10 designates generally a portion of a utility building in course of construction. As is typical in such construction, a concrete slab as 12 may be provided, with upright steel side columns or posts 14, corner posts 15, and end posts 16. Additional studs (not shown) might of course be provided depending on the nature of the side wall construction. The posts carry arched roof supporting rafter elements 18 to which are attached the longitudinal roof purlins 20, ridge purlins 23 and eave struts 22. The purlins and eave struts have flat tops, as is conventional.

Figure 4:
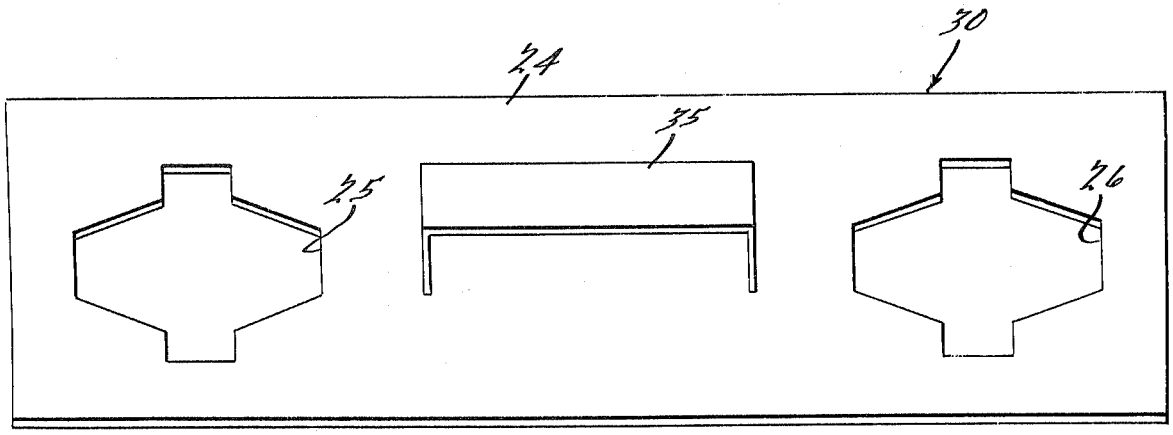
FIG. 4 is a plan view, partially in perspective, of a clip locating template.
Figure 2:
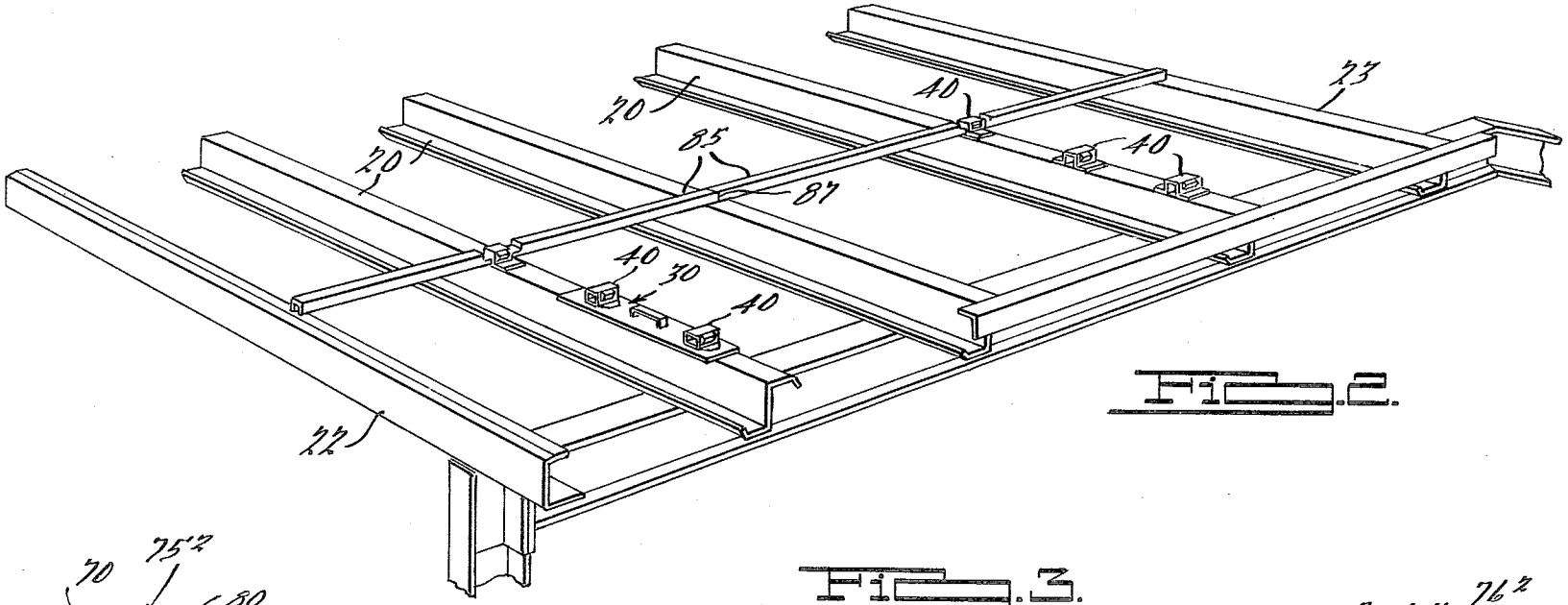
FIG. 2 is a somewhat diagrammatic perspective view on a larger scale of a partially completed roof structure.

As brought out in FIGS. 2 and 4, brackets or clips 40 are adapted to be spaced at desired distances along the purlins 20, 23 by means of a member 30 referred to herein as a "template", but which functions not only as a template, but also as a positioning and holddown device for the clips 40. The template 30 is formed of a flat sheet steel body 24 having two cutout openings 25, 26 therein spaced conformably to the desired spacing of and proportioned to accurately overfit the clips, in a manner to be described, without obstructing screwholes 44, 44' formed in the clips. The template may also be provided with a simple handle 35 in its central area. The first row of clips along the purlins at one gable end of the building from eave to ridge is positioned accurately by measurement. Thereafter, successive clips along a purlin are located in the desired positions by the template, which is fitted over the pre-fastened clip and over a loose clip placed on the purlin (or other structural element), whereafter the loose clip is securely and permanently fastened to the structural element, while being held in place by the template, as by means of heavy self-drilling, self-tapping screws 42 inserted through holes 44, 44' in base flanges 38, 38' of the clip and into the purlin or other supporting structural element.

Figure 5:
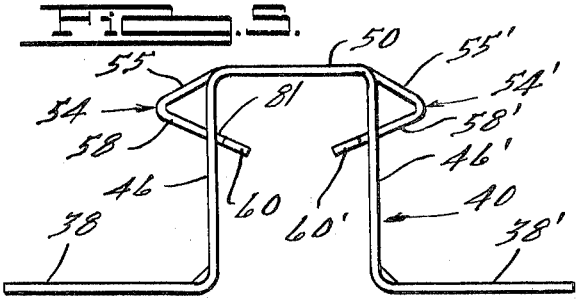
FIG. 5 is an end elevational view of one of the hold-down clips.
Figure 6:
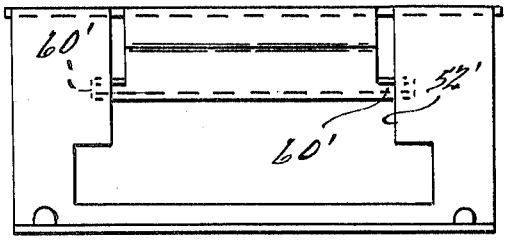
FIG. 6 is a side elevational view of the clip.
Figure 7:
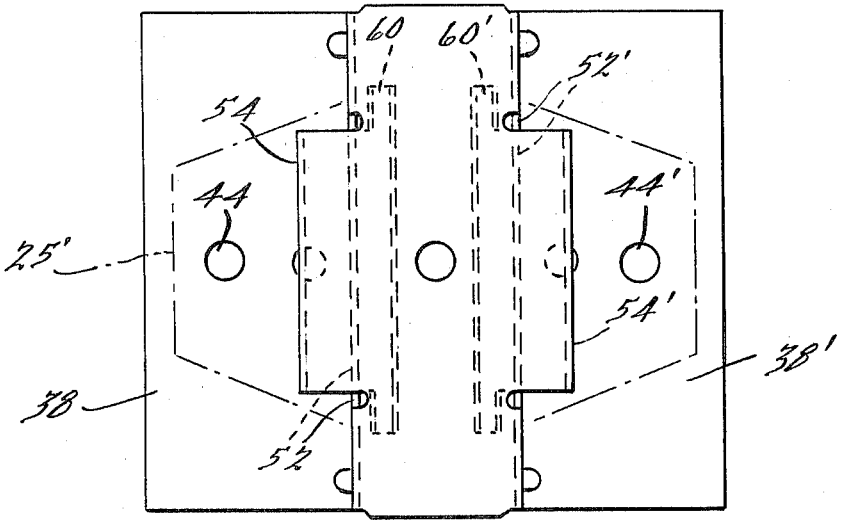
FIG. 7 is a top plan view of the clip.

As shown in detail in FIGS. 5–7, the clips are basically of double-bent form. The spaced parallel upstanding sidewalls 46, 46' extend upwardly from the respective base flanges 38, 38', and are joined by the integral top wall 50. Each of the sidewalls 46, 46' is pierced to form an opening 52, 52' of generally inverted T form and to define a latching tongue 54, 54' the outline of which is similar to that of opening 52 or 52' but sufficiently smaller to be movable laterally in the opening. Latching tongues 54, 54' are comprised of an upper arm 55, 55', which constitutes an outwardly and downwardly sloping integral continuation of top wall 50, and an integral inwardly rebent downwardly and inwardly sloping arm 58, 58', which extends back through the opening 52 or 52'. At the lateral ends of the arms 58, 58' of each latching tongue 54, 54' integral stop lugs as 60, 60' are provided, each of which projects behind the unpierced sidewall portion 46 or 46' in the narrower upper portion of the opening 52 or 52'.

As shown in FIG. 2, clips 40 are attached to the purlins or other frame members as 20 with the flat sidewalls 46, 46' thereof extending transversely. As also shown in FIG. 2, and in FIG. 7 by means of a dotted outline 25' indicating the positioning of one of the cutout openings of the template, the template, during use, partially overlies and bears downwardly upon both of the base flanges 38, 38' of each of the two clips to positively locate and hold the loose clips in the proper relative spatial relation. End portions of the cutout openings of the template accurately position the initially loose clip by fitting closely with respect to the four corners of the upstanding sidewall portions 46, 46' of both clips, while lateral portions of the cutouts are contoured to clear the tongues 54, 54' and the holes 44, 44'. Thus the template fits easily over and is readily lifted clear, and functions not only as a positioning device but also as a device for holding the loose clip in position until secured by the screws.

Figure 3:
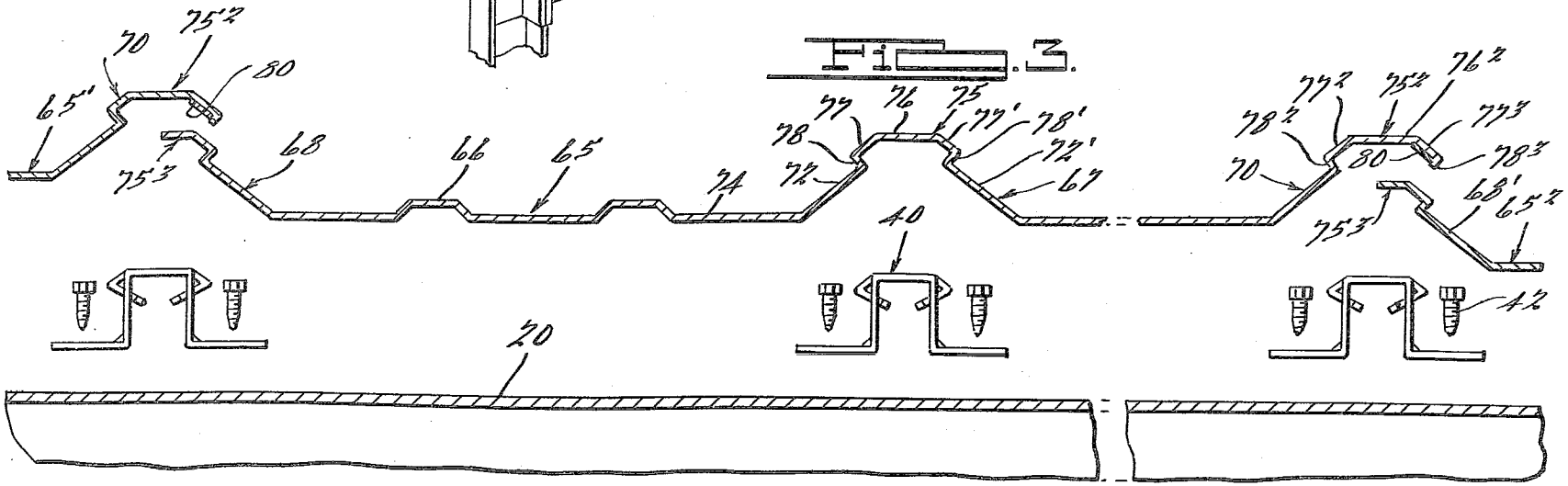
FIG. 3 is a fragmentary exploded sectional elevational view showing a portion of a roof purlin in longitudinal section, and corresponding roof panel members and fastening elements, with the parts separated vertically.

FIG. 5 shows one of the roof panels, generally designated 65, and portions of two adjacent panels 65', and $65^2$. Each panel has longitudinal ribbing which consists, in addition to simple stiffening ribs as 66, of one or more relatively large upstanding medial securing ribs 67 of generally mushroom-shaped cross section extending longitudinally of the panel, and incomplete securing rib portions 68, 70 parallel thereto along the side edges of the panel. The ribs 67 are of a height and width sufficient to overengage the clips 40 and permit the panels to bear on the purlins (or interposed insulation). Each rib 67 consists of two upwardly converging sloping walls 72, 72', rising from the flat main portions 74 which define the base plane of the panel, to a "mushroom" shaped head portion generally designated 75, the interior or under side of which constitutes the securing or holding portion. The head 75 has a flat top 76, the width of which conforms to the width of the flat top wall 50 of the clips 40. Integral outwardly and downwardly sloping wall portions 77, 77' of head 75 conform to and are adapted to closely overlie the latching arms 55, 55' of the brackets to which the panel is applied. Beneath the portions 77, 77', and joining them to the sloping walls 72, 72' respectively are integral downwardly and inwardly sloping wall portions 78, 78' which are adapted to underengage the bottom latching arm portions 58, 58' of the clips. Along one edge, shown at the left of the central panel 65 in FIG. 3, an incomplete rib 68 has a head portion $75^3$ shaped similarly and corresponding to approximately the right half of the completed medial rib 67. The incomplete ribs 70 shown extending along the right hand edges of the panels 65 and 65' incorporating a head portion $75^2$ having wall portions $76^2$, $77^2$, $77^3$, $78^2$, $78^3$ adapted to fit over and complete a seal with the incomplete rib portion as 68, 68' of an adjacent panel and to be interengaged with the incomplete head portion $75^3$ thereof. In order to eliminate any possibility of leakage in event of high turbulence during a rain, a deformable sealing compound 80 of a mastic-type tape or other well-known and suitable sealing agent may be placed inside the incomplete female rib head portion $75^2$ in the region of wall portions $77^3$, $78^3$ thereof (and in other areas to be referred to).

Figure 8:
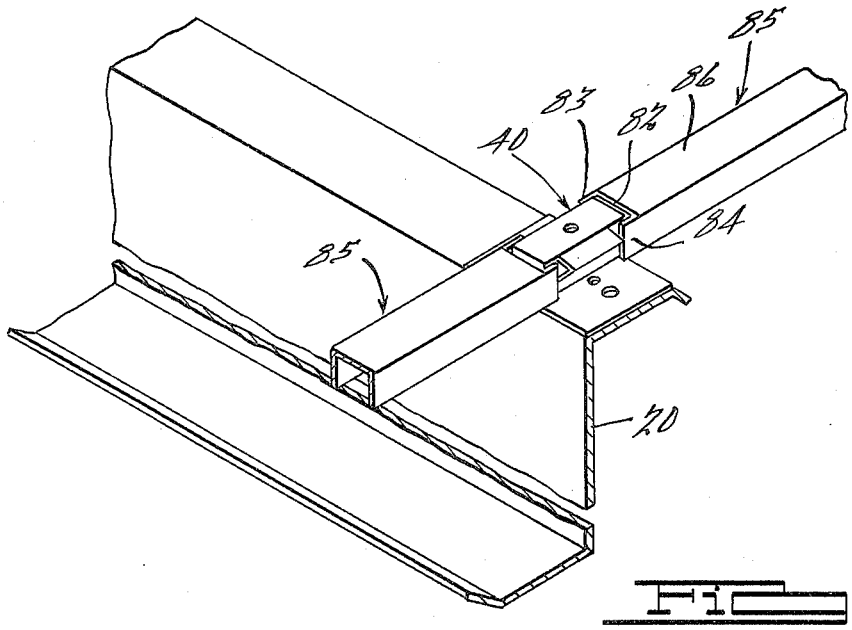
FIG. 8 is a fragmentary perspective view showing the attachment of one of the clips and two lap support channel members to a roof purlin.

To stiffen and support the joints at the lapped edges of the panels, U-channel beam lap supports 85 are provided, adapted to be installed in transverse bridging relation to the purlins and eave struts in such manner as to underlie and support the full length of the lap joints. The central top webs of the lap supports 85 are cut away at one end for a short distance as indicated at 82 in FIG. 8, thereby forming parallel locating tongues, 83, 84, which are coplanar continuations of the side webs of the channel, spaced slightly farther apart than the spacing of sidewalls 46, 46' and adapted to lie closely outside the sidewalls and rest upon the base flanges 38, 38'. The U-channel lap supports are installed inverted, and their height conforms to the elevation of the top walls 50 of the clips, so that the central webs 86 of the lap supports 80 and top walls 50 of the clips form a continuous flat support for the lap joints.

Generally speaking, clips 40 are installed at all locations on all purlins; however, the ends of the panels may be deformed to provide overlap with adjacent panels, eaves, etc. and in those locations, clips are omitted and the contiguous ends of the lap supports are left square, being merely butted together and resting on an intermediate purlin, as shown at 87 in FIG. 2. Lateral displacement of such butted ends is prevented by the clip-engaging ribs of the panels.

The inclination of the ribs and latching tongues and the strength of the materials are such that no wind or suction force which the building could be expected to withstand is capable of pulling the panels free. In this connection it will be noted that the lug portions 60, 60' on the latching tongues lie close to the inner surfaces of the sidewalls 46, 46' of the clips and prevent the latching arms from bending upwardly, so that in order to pull free it would be necessary either for the panels to be greatly distorted, or the lugs 60, 60' to be broken. In normal positioning some clearance 81 is provided between the lugs and sidewalls of the clips, however, to accommodate expansion.

Figure 11:
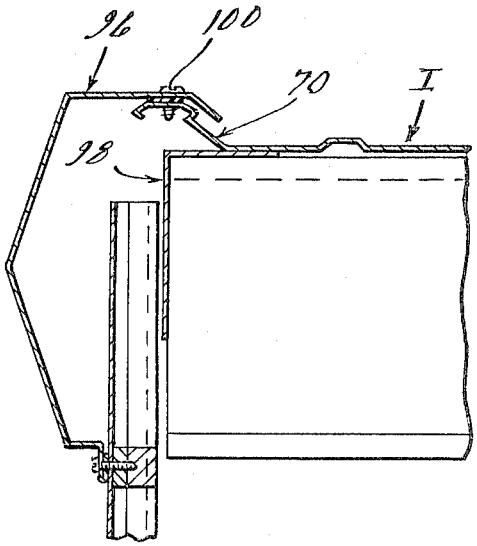
FIG. 11 is a similar sectional detail of the rake area.
Figure 12:
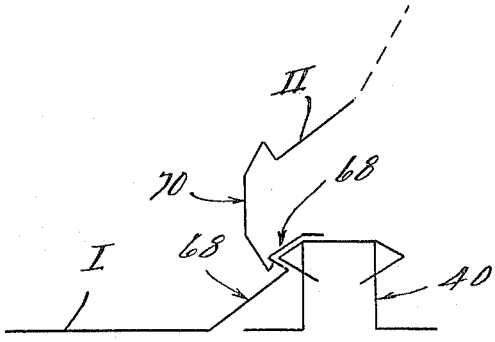
Figure 13:
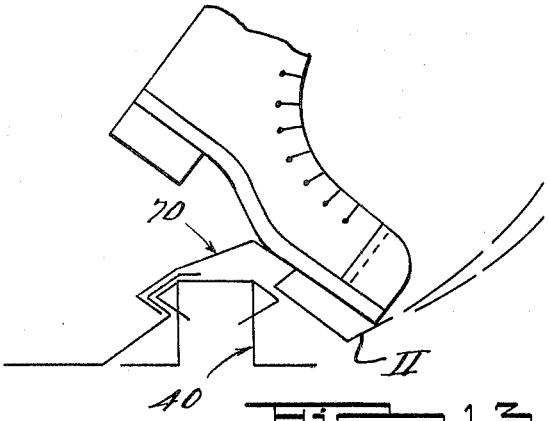
Figure 14:
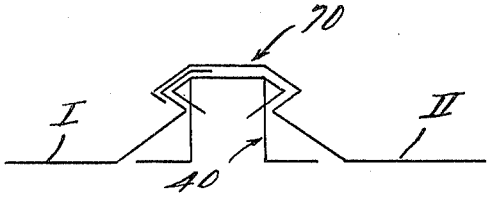
Figure 15:
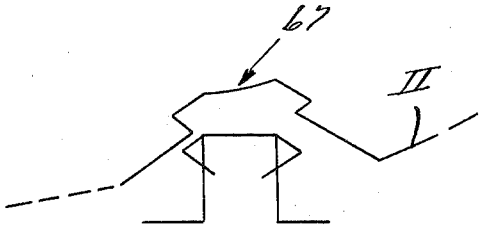
Figure 16:
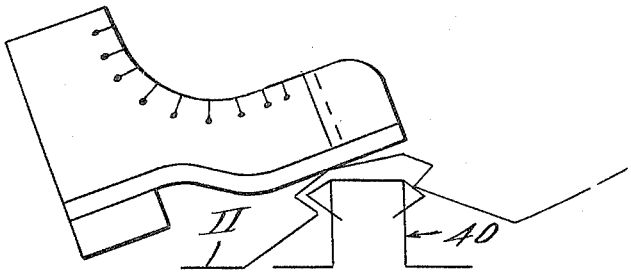
Figure 18:
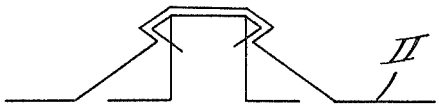
Figure 17:
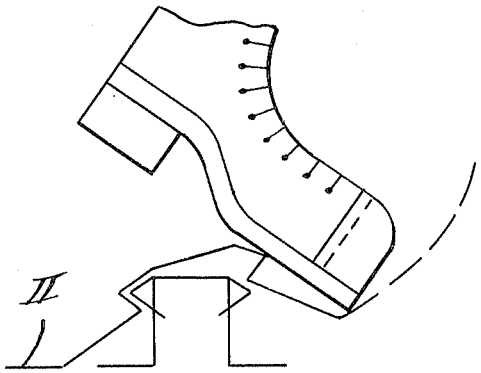

The method of securing the panels together and to the clips is illustrated in FIGS. 12 to 18, inclusive. At their eave ends the panels are secured to the eave strut 22 and to the eave trim 92 by screws positioned as indicated at 94 and 95 in FIG. 10 in a manner to be more fully described hereinafter. In installing the first panel at one of the rake ends, as best shown in FIG. 11, the partial rib portion 70 at the edge of the first panel is slipped beneath the rake trim member 96 and over the rake angle 98 and secured in place by means of screws as indicated at 100, suitable sealant being employed. Such first panel is designated I in FIGS. 11 and 12 and its holding ribs are then progressively secured to the holding clips in the manner shown in FIGS. 12–18. Its partial edge rib 68 then lies against and partly overlies the clip as indicated in FIG. 12. The complementary partial edge rib portion 70 of the second panel, II, is then hooked under the lip of rib portion 68 of the previous panel with panel II in the inclined position as shown in FIG. 12, after which it is rotated downwardly as shown in FIG. 13. Foot pressure applied as shown in FIG. 13 along the side farther from such hooked parts will cause the farther side of the holding rib portion 70 to snap over the tongue 54 or 54' of the clip and to the position indicated in FIG. 14, at which time the medial rib 67 of panel II will overlie the next clip 40 as shown in FIG. 15, and can be pressed to locked position by foot pressure in the manner shown in FIGS. 16 and 17. The latched condition of the medial rib is shown in FIG. 18. The medial rib will in some instances snap over both tongues at the same time, depending upon the foot position, although it is preferred to interlock them successively as shown in FIGS. 16 and 17. The remaining panels required to reach to the opposite rake are installed in like manner, the designed building length preferably being an integral multiple of panel width.

FIGS. 19 and 21 each illustrate an assembly of roofing panels of the preferred construction as employed on a portion of one of the flat surfaces of a sloping roof. FIG. 19 shows panels which extend upwardly from the eave and FIG. 21 shows panels which extend downwardly from the ridge and which are adapted to be overlapped and sealed with relation to the lower series of panels shown in FIG. 19. FIG. 22 illustrates the construction of a cooperating ridge panel. These views disclose preferred features of the end portions of the panels and of the securing and sealing means employed at the eave and ridge ends, and also at lap areas where two or more rows of the panels are required in order to reach from eave to ridge.

Figure 1:
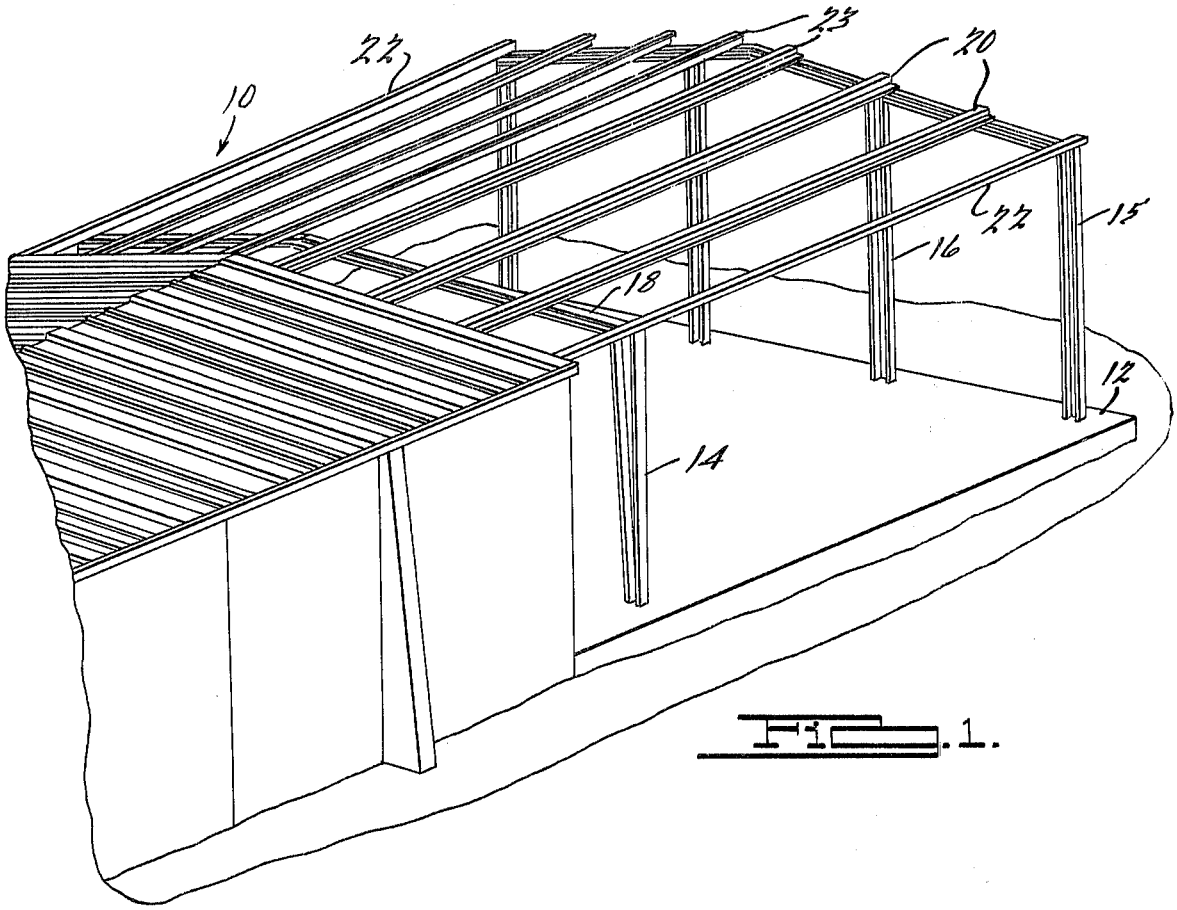
FIG. 1 is a somewhat diagrammatic perspective view of a partially completed building structure incorporating the principles of the present invention.
Figure 10:
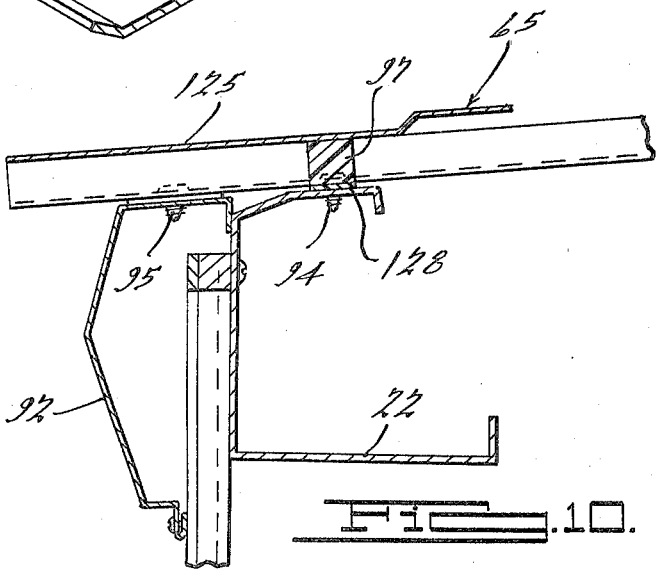
FIG. 10 is a fragmentary sectional detail of the eave area of a roof installation constructed in accordance with the invention.

Referring to FIGS. 19 and 20 in conjunction with FIG. 10, it will be seen that the panels have the ends 125 of their holding rib portions reduced in height. This is accomplished by folding the dovetail areas into tightly crimped portions, on each side of the rib, as indicated at 126 in FIG. 20. Both ends of all of the complete and partial securing ribs 75, $75^2$, $75^3$, etc. of each panel are provided with such areas 125 of reduced height for a distance inwardly from the end sufficient for convenient lapping where required (approximately five inches, in a construction successfully employed). The reduced height of the end portions 125 promotes weather-tight sealing at lapped end areas, and where, at the eave ends of the panels they overlap the inside closure member 97 (FIG. 10) and the sealing strip 128. Commercial screw-type fasteners (self-drilling or self-tapping) equipped with sealing washers under their heads are driven through the panels near each end at locations such that the screws are adapted to pass through the inside closure 97 and sealant 128 and the top of the eave strut 22 to sealingly secure the panels to the eave strut. If the fasteners are not self-drilling, aperatures 130 are drilled through the panels. If the panels are of sufficient length to reach to the ridge purlin 23 and rest thereon as shown in FIG. 21, a sealant strip as indicated at 134 is laid across the reduced upper end portions for the full width of the panel assembly. Thereafter special ridge panels 105 formed to provide a properly arched contour and to bridge the two spaced ridge purlins 23 (FIG. 1) are provided. The ridge panels, the construction of which is shown in FIG. 22, are also provided with end portions 125' of reduced height at both ends of each complete and partial securing rib. All of the ribbing of the ridge panels conforms to that of the regular flat panels, the reduced end portions of the holding ribs of the ridge panels being adapted to overlie the conformably reduced end portions 125 of the regular panels. The ridge panels are secured to the ridge purlins through the sealant by sealing-type fasteners driven through the mating holes in the ridge panel and overlapped regular panel ends. A sealant tape or other suitable sealant as shown at 135 may also be provided on the male lap rib portions $68^4$ of each ridge panel to seal the joints between such panels.

Although FIG. 10 shows the use of only eave trim in the eave area, it should be appreciated that a gutter may also be used in this area as a part of the present panel system.

The length of all of the regular panels conforms to a multiple of the purlin spacing and where the required length due to a distance from eave to ridge necessitates lapping the ends of panels, they overlie a purlin in the lapped area, the lower series of panels having their reduced upper end areas overlaid by the reduced end portions of the upper panels. Sealant, indicated at 138 in FIG. 19, is placed over the pierced upper ends of the lower panels to effect a seal with the lower ends of the upper panels. After the upper panels are so overlaid, they are secured by sealing-type fasteners projected through the overlapped panel portions and sealant into the purlin through the pierced hole.

Figure 9:
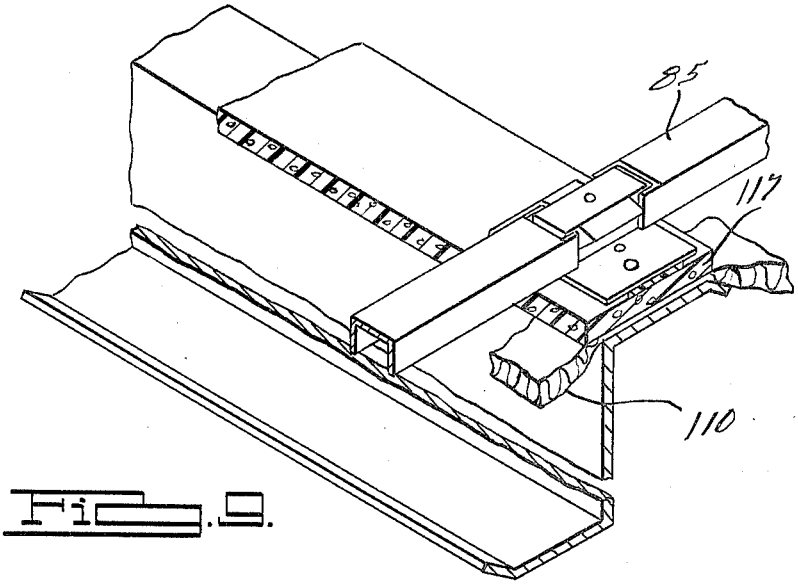
FIG. 9 is a view similar to FIG. 8 showing a method of installing thermal insulation in connection with the roof structure.

As shown in FIG. 9, thermal insulation is readily installable in connection with this panel construction. FIG. 9 illustrates a convenient method of providing such insulation by means of thermal blanketing, partially shown at 110, initially laid over the purlins, and a thermal block member 117 laid over the blanket along the purlins prior to attachment of the clips and lap supports in the manner described.

This Detailed Description of the Preferred Form of the Invention and the accompanying drawings have been furnished in compliance with the statutory requirement to set forth the best mode contemplated by the inventor of carrying out the invention. The prior portions consisting of the "Abstract of the Disclosure"

and the "Background of the Invention" are furnished without prejudice to comply with administrative requirements of the Patent and Trademark Office.

While a preferred embodiment of the invention has been described herein, it will be appreciated that various modifications and changes may be made without departing from the spirit and scope of the appended claims.

I claim:

1. A sheet metal building panel having latchable holding portions on its under surface defined by a longitudinally extending upstanding embossed rib of a generally mushroom-shaped cross section and which includes laterally angularly, outwardly and downwardly divergent wall portions and integral continuation wall portions formed as inward and downward continuations of said divergent wall portions, said continuation wall portions being frictionally overfittable upon and adapted to interlatch with subjacent holding clips secured to a structural element of a building, characterized by a relatively short end portion of said rib which is of a reduced height, the continuation wall portions being upwardly and inwardly deformed in said end portion of reduced height.

2. A sheet metal panel as defined in claim 1, wherein said rib comprises a medial rib which extends longitudinally of a medial portion of the panel, a partial rib on each longitudinal edge of the panel, each partial rib including outwardly divergent wall portions and inwardly convergent continuation wall portions and substantially corresponding in cross-section to a portion of the medial rib and each partial rib being interfittable with a partial rib on an adjacently positioned panel to define a complete rib of cross section corresponding to that of the medial rib, further characterized in that each of said partial ribs includes a relatively short end portion of reduced height including an upwardly and inwardly deformed part of the continuation wall portion.

3. A paneled construction comprising a plurality of rows of elongated panels, the individual panels of each row being interlocked in parallel side-by-side longitudinally extending relation, the rows being arranged in partially overlapped end-to-end relation, said panels having longitudinally extending ribs of generally mushroom-shaped cross section adapted to holdingly interlatch with subjacent blind holding clips secured to a building frame member, end portions of said ribs in the overlapped region being substantially reduced in height, and sealing material extending transversely of the ribs and panels between and in engagement with the overlapped panel portions of reduced height.

4. In a building construction in combination with a plurality of spaced parallel supporting structural elements, a row of elongated side-abutting panels extending in overlying transverse relation to said structural elements, said panels having upstanding ribs at their abutting side edges, said ribs being defined by a pair of partial ribs, one of such partial ribs being carried by each such abutting edge, the partial ribs of each pair of abutting panels being interlocked and coacting to define an elongated opening of generally mushroom-shaped cross section facing toward the overlaid structural elements and adapted to overengage and holdingly interlatch with upper portions of subjacent holding clips secured to and upstanding from the structural elements, and edge supporting strut members extending in bridging relation over said structural elements beneath said interlocked partial ribs to support such ribs in areas between the spaced structural elements, said strut members being interfitted with lateral portions of said holding clips.

5. In a building construction in combination with a plurality of spaced parallel supporting structural elements, a row of elongated side-abutting panels extending in overlying transverse relation to said structural elements, said panels having upstanding ribs at their abutting side edges, said ribs being defined by a pair of partial ribs, one of which partial ribs being carried by each such abutting edge, the partial ribs of each pair of abutting panels being interlocked and coacting to define an elongated opening of generally mushroom-shaped cross-section facing toward the overlaid structural elements and adapted to overengage and holdingly interlatch with upper portions of subjacent holding clips secured to and upstanding from the structural elements, and edge supporting strut members extending in bridging relation over said structural elements beneath said interlocked partial ribs to support such ribs in areas between the spaced structural elements, said strut members substantially conforming in height to said clips and to the internal height of said ribs.

6. A building construction as defined in claim 4 wherein said strut members substantially conform in height to said clips and to the internal height of said ribs.

7. The method of erecting a paneled building structure of the type comprising panels having a bottom surface which incorporates a plurality of spaced holding parts adapted for securance to subjacent holding clips fastened to elongated supporting structural elements of a building, which method includes securing such clips to such structural elements in a spatial relation conforming to the spacing of said holding parts of the panels by steps which comprise fastening one of such clips to such a structural element in a desired initial position, interfitting with said fastened clip and with a loose second clip positioned on the structural element, the locating portions of a combined locating and hold-down member, said locating portions being spaced conformably to said spatial relation, fastening the loose clip to the structural element while both clips are interfitted with the locating and hold-down member, and thereafter lifting said member from the clips prior to applying and securing a panel to the clips.

8. A method as defined in claim 7 wherein a plurality of clips are fastened to a plurality of parallel structural elements, including the further steps of laying supplemental supports transversely across and in bridging relation to said structural elements and in interfitted relationship with clips on different ones of said structural elements and thereafter securing panels to the clips in closely overlying relation to said supplemental supports.

9. The method of erecting a paneled building structural of the type comprising a plurality of panels extending transversely over a plurality of elongated spaced parallel supporting structural elements of a building and secured from beneath by means of holding clips attached to such spaced structural elements in transversely aligned relation, which method includes the steps of laying supplemental supports transversely across and in bridging relation to said structural elements and in interfitted relationship with such transversely aligned clips prior to installing the panels, and thereafter securing the panels to the clips in closely overlying relation to said supplemental supports.

* * * * *

UNITED STATES PATENT AND TRADEMARK OFFICE

CERTIFICATE OF CORRECTION

PATENT NO. : 4,406,106

DATED : September 27, 1983

INVENTOR(S) : Kenneth N. Dinges

It is certified that error appears in the above-identified patent and that said Letters Patent are hereby corrected as shown below:

Column 3, line 66, "5" should be -- 3 —.

Column 4, line 30, "incorporating" should be -- incorporate --.

Column 8, lines 55 and 56, "structural" should be — structure —.

Signed and Sealed this

*Fifteenth* Day of *May 1984*

[SEAL]

*Attest:*

GERALD J. MOSSINGHOFF

*Attesting Officer*

*Commissioner of Patents and Trademarks*